United States Patent [19]

Hense et al.

[11] 4,010,523

[45] Mar. 8, 1977

[54] PROCESS FOR THE PRODUCTION OF A NOVELTY YARN

[75] Inventors: Karl-Hermann Hense, Erlenbach; Thomas Zang, Hosbach, both of Germany

[73] Assignee: Akzona Incorporated, Asheville, N.C.

[22] Filed: July 23, 1975

[21] Appl. No.: 598,261

[30] Foreign Application Priority Data

July 27, 1974 Germany ..... 2436277

[52] U.S. Cl. ..... 28/72.11; 28/72.12

[51] Int. Cl.[2] ..... D02G 1/20

[58] Field of Search ..... 28/72.11, 72.12; 57/157 F

[56] References Cited

UNITED STATES PATENTS

| | | | |
|---|---|---|---|
| 3,105,349 | 10/1963 | Palm et al. | 57/157 F X |
| 3,332,125 | 7/1967 | Davis et al. | 28/72.12 X |
| 3,517,498 | 6/1970 | Burellier et al. | 28/72.12 X |

FOREIGN PATENTS OR APPLICATIONS

| | | | |
|---|---|---|---|
| 683,257 | 3/1964 | Canada | 57/157 F |
| 1,029,097 | 5/1966 | United Kingdom | 28/72.11 |

OTHER PUBLICATIONS

Ferrer, S. M. Core-and-Effect with Taslan, Man-made Textiles, Feb. 1965, pp. 29, 30.

*Primary Examiner*—Robert R. Mackey
*Attorney, Agent, or Firm*—Johnston, Keil, Thompson & Shurtleff

[57] ABSTRACT

A process for producing a composite novelty or effect yarn comprising a base thread and a fancy thread combined therewith in a texturizing jet nozzle having both an interlacing effect and a suction effect and operated between a low jet pressure and a high jet pressure, the low pressure being applied while the fancy thread is conducted through the jet nozzle under a lightly braked, lower tension than that applied to the base thread, and the high pressure being applied while the fancy thread is conducted through the jet nozzle under practically unbraked, tension-free conditions. The resulting product is useful as a doupion-type novelty yarn which provides commercially valuable effects in woven fabrics.

10 Claims, 5 Drawing Figures

PROCESS FOR THE PRODUCTION OF A NOVELTY YARN

Figure 1:
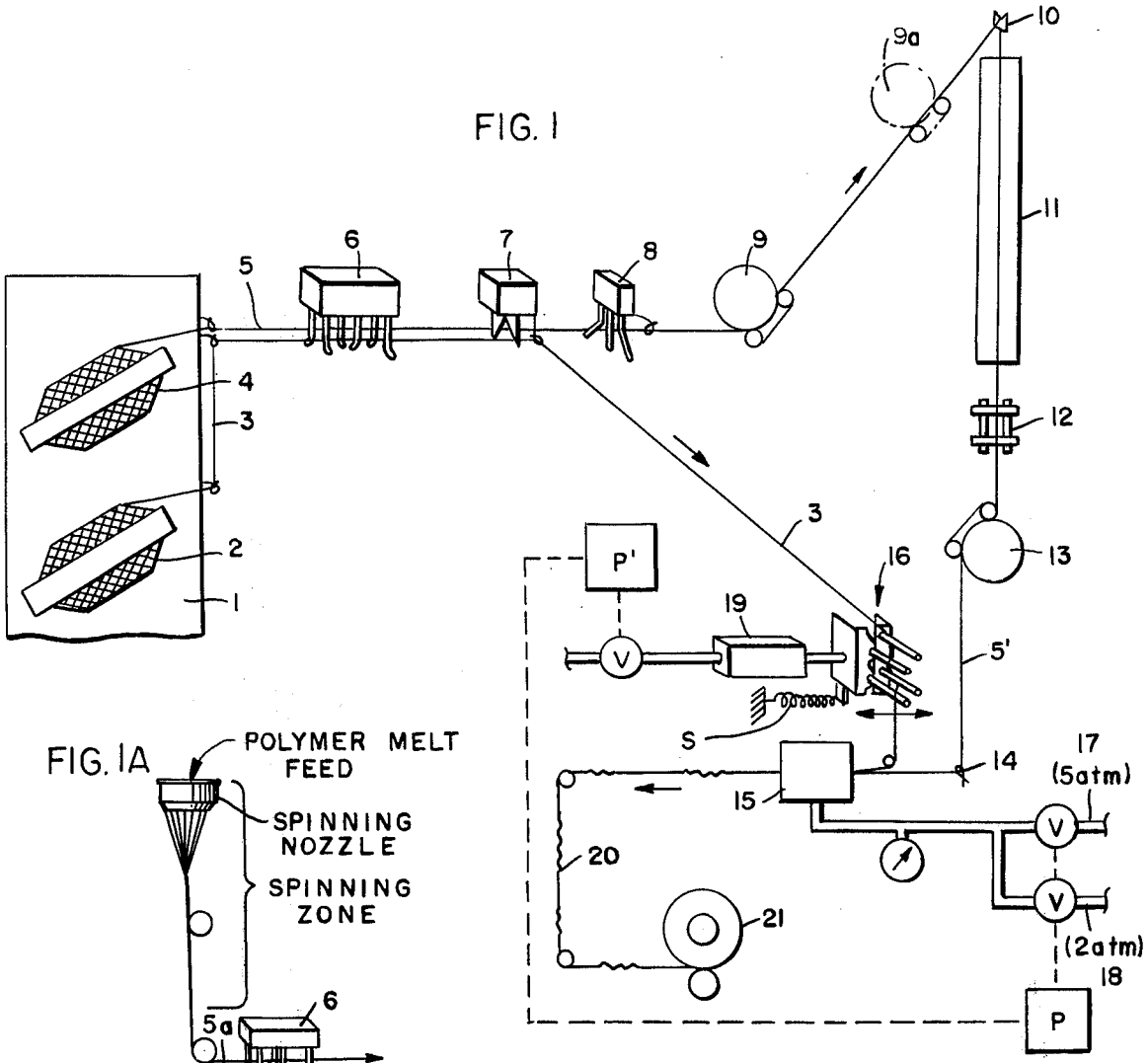

One process for achieving doupion-like effect is known from U.S. Pat. No. 3,517,498 in which a fluid medium is conducted intermittently into the jet nozzle, i.e., the jet medium flows into the nozzle only at specific intervals. Compressed air is used as the jet medium and when applied, it causes a suction action with a lightly tensioned fancy thread being overfed, and also causes an interlacing of the loop-forming fancy thread with the base thread being conducted under a higher tension. In this type of process, it is common to use base threads and fancy threads which preferably consist of untwisted, continuous, multifilament bundles or yarns, the physical and/or chemical properties of which can be quite different from each other. The resulting novelty yarn possesses relatively poor processing and handling properties because those portions of the yarn which have passed through the jet nozzle with the compressed air in the off position exhibit an insufficient coherency or cohesiveness as between the base thread and the fancy thread. On the other hand, if the yarn is then twisted in order to improve its cohesiveness for further processing, then the desired fancy effect at intermittent points with an already poor covering power is further diminished or even lost for practical purposes.

It is an object of the present invention to provide an improved process for the production of a doupion-type novelty yarn which is more easily obtained with high voluminosity, good covering power and a good cohesiveness between the base thread and fancy thread over the entire length of the novelty yarn product, even between the so-called "effect" or "thick" points of the yarn. This cohesiveness must be sufficient to permit the yarn to be used in a trouble-free manner in subsequent textile operations, e.g., winding, finishing, feeding, tensioning, weaving, knitting and the like. The novelty yarn produced by the process of the present invention achieves this result while also permitting a very wide variation in interesting yarn and patterned fabric effects.

It has now been found, in accordance with the invention, that such highly useful composite novelty yarns with good cohesion can be obtained in a process including the steps of conducting a continuous multifilament base thread together with a continuous multifilament fancy thread through a texturizing jet nozzle operating under an adjustable pressure of a fluid medium and acting to induce both an interlacing action and a suction action when applied to the combined base and fancy threads, at least the base thread consisting essentially of texturized filaments, varying the pressure of the jet fluid medium applied to said threads between a lower value above atmospheric pressure and a distinctly higher value, maintaining a relatively high uniform tension on the base thread such that it follows a substantially linear path through the jet nozzle, maintaining a distinctly lower tension by a light braking on the fancy thread as compared to the tension on the base thread, this light braking taking place during the application of the lower value of the jet pressure, and maintaining the fancy thread practically tension-free and unbraked during the application of the higher value of the jet pressure.

In principle, one may use threads, yarns or similar filamentary bundles of quite different types of materials in the process of the invention, but it is especially desirable to provide a novelty product made from synthetic thermoplastic threads, i.e. continuous multifilament threads composed of thermoplastic fiber-forming polymers such as polyamides, polyesters, polyolefins, polyacrylonitrile and the like. Nylon and polyethylene terephthalate threads are especially suitable.

In general, good results are ensured if the process of the invention is carried out with at least the base thread being a texturized yarn. Moreover, very good cohesion between the base thread and the fancy thread is achieved when at least the base thread is a texturized yarn and especially when both the fancy thread and the base thread are texturized yarns. The specific type of texturizing is not of primary importance since all texturizing processes impart a crimping to the previously straight or even filaments in the yarn so as to increase the voluminosity of the yarn or thread and give it an open and bulky appearance. Extensive details concerning the preparation of texturized yarns may be found in the book "Woven Stretch and Textured Fabrics," by Hathorne, Interscience Publishers, Division of John Wiley & Sons, New York (1964), incorporated herein by reference.

For commercial purposes, it is especially useful in carrying out the process of the invention to use both a base thread and a fancy thread composed of a false-twist texturized yarn which can be initially produced in a conventional manner, e.g. by the type of texturizing process using a false-twist spindle or twist tube. Frictional false-twist texturizing apparatus may also be used to achieve satisfactory texturized yarns. Such false-twisted and usually heat-seat yarns may also be referred to as "torque-crimped yarns" and are of particular advantage because they can be produced in a continuous manner at relatively high speeds from conventional freshly spun and preferably stretched continuous fiber-forming polymer filaments. The stretching may take place before or in the false-twist texturizing zone in any conventional kind of stretch and false-twist procedure. Attention is again directed to the Hathorne book which discusses false-twist texturized or torque-crimped yarns in considerable detail. There is also a large body of patents directed to such false-twist texturized yarns, and one skilled in this art can readily adapt these yarns for continuous processing directly into the novelty product of the present invention.

Thus, it is possible to accomplish the production of the present novelty yarn product along with many conventional thread producing or thread processing operations. From the above discussion and as illustrated more fully below, it is preferable to use a texturized thread as at least the base thread delivered directly from a texturizing zone, i.e. before the texturized thread is wound or spooled. The fancy thread, again preferably in texturized form but also available as a non-texturized bundle of straight non-crimped filaments, is advantageously drawn off from a spool frame or a similar feed package and introduced together with the base thread into the jet nozzle. One can thereby change quickly from one type of fancy yarn to another while using the same continuously supplied base thread. Novelty products with wide variations in surface appearance, e.g. thick-and-thin variations of voluminosity, can be easily produced while maintaining very similar properties of strength and uniform textile processing due to the use of the same base thread.

Finally, it is also quite possible to combine the process of the invention for making novelty products with both the preceding texturing process and the conventional spinning process for the initial extrusion or spinning of the fiber-forming filaments. In this manner, one can provide an overall continuous process from the initial fiber-forming polymer to the final novelty yarn product. The well known spin-stretch-texturizing process including those operated at high speeds are therefore quite useful in direct combination with the process of the present invention.

As a rule, the jet nozzle used in the process of the invention is operated with the introduction of compressed air under otherwise normal or ambient atmospheric conditions. Heated air or a saturated or unsaturated steam as the fluid jet medium is employed only if special shrinkage or fixing effects are to be achieved.

The pressure of the fluid medium introduced into the jet nozzle is relatively low, for example up to about 10 atm., because one should generally avoid the excessively high pressures used when the nozzles are intended for a first texturizing or heat-crimping of a freshly spun filamentary yarn, sometimes called an "air-bulking" process. It should be understood, therefore, that the term "texturizing jet nozzle" is employed herein in its broadest sense to include the use of such nozzles for mild yarn treatments which do not place a permanent deformation or crimp into the individual filaments. The "jet texturizing" of the present invention essentially involves an interlacing and entangling of a base thread and a fancy thread at predetermined portions and points along the length of the yarn, preferably with an already crimped or fully texturized base thread and most often a similarly crimped or fully texturized fancy thread. The fluid-operated nozzle may also be referred to as a "blowing jet," a "blast nozzle" or a "resonating and suction jet nozzle." Suitable nozzles are discussed more fully below, but it is important that the jet nozzle provide both an interlacing effect and also a suction-effect as known functions of nozzles which can be readily designed for these combined effects.

In carrying out the essential combination of pressure variation and tension variation steps in accordance with the invention, it is especially advantageous to vary the jet pressure by switching back and forth between the lower and the higher pressure values according to a predetermined program while applying the light braking of the fancy thread simultaneously with a switching to the lower pressure value and then releasing this braking of the fancy thread simultaneously with a switching to the higher pressure value.

Figure 1A:
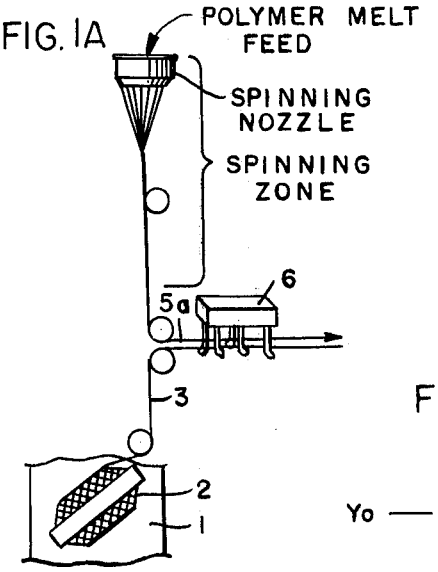
Figure 2:
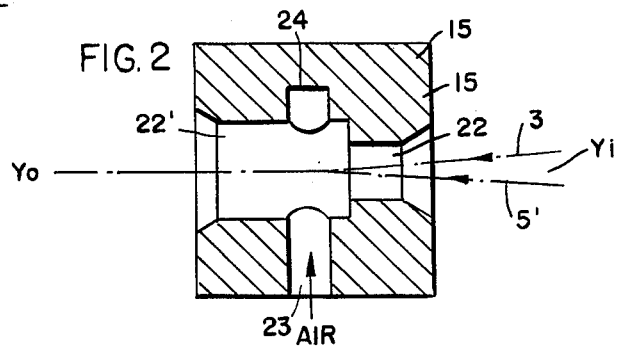
Figure 3A:
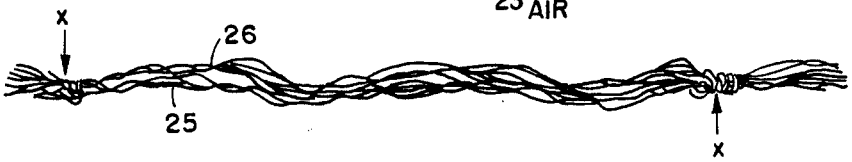
Figure 3B:
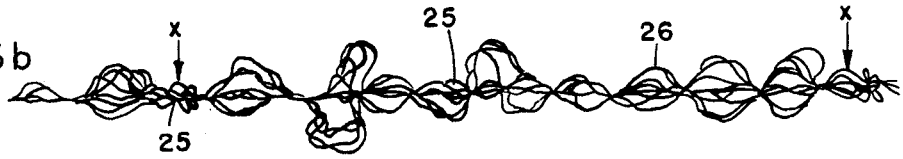

The invention will now be explained in more particular detail in conjunction with the accompanying drawing in which:

FIG. 1 is a schematic flow-sheet representation of one embodiment of the process of the invention on producing a novelty yarn product from a texturized base thread and a fancy thread;

FIG. 1*a* is an alternative schematic flow-sheet illustration of a supply of one base thread directly from a spinning zone;

FIG. 2 is a cross-sectional view of one preferred jet nozzle used for the process of the invention;

FIG. 3*a* is a partly schematic illustration of one segment representing the "thin" portion of the novelty yarn produced according to the invention; and FIG. 3*b* is a partly schematic illustration of another alternate segment of the same yarn as FIG. 3*a* to show the "thick" portion of the novelty yarn product.

Referring first to FIG. 1, a spool or bobbin frame 1 carries a first feed spool 2 wound with a texturized or a smooth non-texturized fancy thread 3 and a second feed spool 4 for a stretched but still untexturized base thread 5. Both the fancy thread 3 and the base thread 5 run through a thread brake 6 and a cutting device 7 which is operated over a detector or monitoring device 8, placed as shown and/or at a point between the cutter 7 and the thread brake 16. Such relay-operated cutters are conventional in permitting both threads to be removed from operation upon a breakage, dropping out or malfunction of either thread alone. Other conventional apparatus may also be used including suitable thread guides or deflection means and various rolls, godets or the like, including positive feed rolls for advancing the threads.

The base thread 5 is first conducted by the feed rolls 9 over a deflecting thread guide 10 and into a heating zone provided by a heating plate or block 11 or a suitable heating chamber which permits the false twist running back from the false-twister 12 to be heat set into the base thread. The base thread 5' in texturized form is then drawn off from the twister 12 by means of draw rolls 13 which may be used when required to provide a stretching of the base thread 5, e.g. by operating the draw rolls 13 at a higher speed then the feed rolls 9.

The initially texturized base thread 5' is then directed by the thread guide 14 into the jet nozzle 15, shown in greater detail in FIG. 2. At this point, the base thread 5' joins the fancy thread 3 to run together through the jet nozzle 15 which is operated by means of two compressed air conduits 17 and 18 maintained under different positive pressures. Tension in the fancy thread 3 is applied or released by the braking device 16. The resulting novelty or effect yarn 20 is subsequently withdrawn and wound on the take-up means or winding device 21.

The compressed air line 17 can be used to supply the jet at the higher pressure value, e.g. at 5 atm. gauge, while the other compressed air line 18 can be maintained at a lower jet pressure value of 2 atm. gauge. The two air lines are controlled by their respective solenoid valves so that they operate in tandem, i.e. line 17 being turned on as line 18 is turned off or vice versa. The same result can be achieved of course by using a two-way solenoid valve at the juncture of the two lines 17 and 18. In this manner, the pressure in the jet nozzle is alternately changed between the two constant values of 5 atm. and 2 atm. (gauge). The term "gauge" is being used here in its ordinary sense to refer to the pressure of the compressed air above atmospheric pressure, i.e. as measured by an ordinary gauge.

In general, it has been found that a wide variety of filamentary threads can be combined and formed into a novelty yarn product in accordance with the process of the invention. For example, with the combined base and fancy threads having a total yarn size of up to about 250 dtex, it is quite useful to provide upper pressure values in the range of about 4.0 – 5.0 atm. gauge and lower pressure values of about 0.5 – 2.0 atm. gauge. Again, one will seldom exceed an upper pressure value of about 10 atm. gauge or a lower pressure value of about 6.0 atm. gauge. At these preferred pressure ranges of 0.5 – 2.0 (lower) and 4.0 – 5.0 (upper) atm.

gauge, it is possible to cause sufficiently strong and tight interlacing of the filaments on the one hand while also providing a sufficiently high suction effect on the other hand.

When working with the preferred pressure ranges as just noted, it has been found to be especially advantageous to conduct the base thread to the jet nozzle with an overfeed of about 2.5 – 3.5 percent.

The absolute winding tension on the composite novelty yarn product with a yarn size of up to about 250 dtex preferably amounts to about 6 – 10 grams. Given with reference to the yarn size, this winding tension should thus lie between about 0.025 and 0.04 g/dtex.

Any suitable programming means P can be used to operate the solenoid valves controlling the alternate supply of compressed air from the high pressure line 17 and the low pressure line 18, for example a simple electrical switching program which can provide regular or irregular intervals at each pressure and which can produce uniform or random lengths of thick and thin portions along the yarn. This program P can also be combined or coupled with the solenoid valve for the braking device 16 as indicated at P'. In this manner, the jet pressure can be varied by switching back and forth between the lower and higher pressure values of lines 17, 18 according to a predetermined program, the light braking of the fancy thread being applied simultaneously with a switching to the lower pressure value and then being released simultaneously with a switching to the higher pressure value.

As indicated in FIG. 1, the thread brake 16 is operated pneumatically by a piston-cylinder control means 19 coupled through its operating valve to the valves in lines 17 and 18 by programming means P'—P. Thus, as the solenoid valve on the brake designated as V,19 is closed, the brake 16 is applied to the fancy thread 3, e.g. by a tensioning spring S, resulting in a light braking tension at the same moment that the low pressure solenoid valve, designated as V,18 is switched on (opened). Subsequently, i.e. at a predetermined interval of the programming means P—P', the valve V,19 is opened permitting the brake 16 to be quickly released while the valve V,18 is closed and V,17 is opened to the higher pressure line.

When the fancy thread 3 is free of tension, i.e. when brake 16 is in a position where its braking rods are open and substantially free of contact with the running thread, the higher jet pressure of 5 atm. gauge, for example, creates a strong suction effect in the jet nozzle 15 and there is a practically automatic large overfeed of the fancy thread 3 so as to produce the kind of effect shown in FIG. 3*b*. On the other hand, when the fancy thread 3 is placed under light tension, the lower jet pressure of 2 atm. gauge, for example, causes a more gentle but still cohesive interlacing covering effect as shown in FIG. 3*a*. Because the light tension applied to the fancy thread 3 is always less than that applied to the texturized base thread 5', one can still achieve a certain degree of bulking and interlacing in the "thin" portions shown by FIG. 3*a* as well as in the more strongly developed loops and curls of the "thick" portions of FIG. 3 3*b*.

In place of the supply spool 4 in FIG. 1, one can also feed the base thread 5 from a spinning spool or, as shown in FIG. 1*a*, directly from a spinning zone in the form of an unstretched or incompletely stretched thread or yarn 5*a*. In this case, it is possible to adjust the feed and draw rolls so that the thread is completely stretched to develop desirable physical properties during the texturizing process. One may also arrange an additional draw roll assembly 9*a* between the heater 11 and the feed roll assembly 9 so as to completely stretch the base thread 5 prior to the particular texturizing treatment. These and similar variations have not been shown since they are conventional adaptations of spin-draw or spin-stretch-texturizing operations.

The type of jet nozzle 15 useful in the process of the invention is illustrated by way of example in FIG. 2. In general, the housing or body of the jet nozzle 15 contains a narrower bore 22 on the entry side Yi of the nozzle to receive the combined base thread 5' and fancy thread 3 and a large bore 22' on the exit side Y*o* where the treated threads emerge as a single composite novelty thread or yarn. The compressed air is continuously introduced into the interior of the nozzle through opening 23 as indicated. Opposite this opening 23, there is located a so-called resonance chamber 24 which produces a very desirable resonating turbulence of the air being introduced into the nozzle, and it is this reasonance chamber which is of primary importance in causing the desired interlacing and entangling action of the two threads. The more highly tensioned base thread 5' is not texturized by the resonating effect and the individual filaments tend to remain in place as the base thread 5' is drawn through the nozzle. On the other hand, there is a much greater lateral displacement of the fancy thread 3 as it passes through the jet under a smaller braking tension or practically no tension at all, and the exact effect is varied by the combined application of tension and low pressure or by the simultaneous release of tension with a higher pressure.

Thus, at the lower air pressure, both of the threads are conducted through the jet nozzle at about the same velocity. The almost parallel running filaments are thereby interlaced and strongly entangled at spaced intervals along the yarn as indicated by the points "X" shown in FIGS. 3*a* and 3*b*. This means that there is a very strong cohesion or interlocking attachment of the base thread 25 with the fancy thread 26 over the entire length of yarn, regardless of whether one is operating at the low pressure value of the high pressure value.

At the higher pressure value, the so-called "suction effect" is exerted by the larger bore 22 placed on the exit side of the nozzle. The injected compressed air at 23 preferentially tends to escape through this larger bore and, with the braking tension on the fancy thread released, it tends to be strongly sucked into the nozzle through bore 21 under a high overfeed and tension-free condition so as to lay the fancy thread with relatively large loops, coils, whorls or the like around the base thread but still with individual points of interlacing or entanglement X at spaced intervals along the yarn. In FIG. 3*b*, the larger entwined loops of the fancy thread 26 are contrasted with the closed interlacing effect at X on the base thread 25.

It will thus be seen that there is a regular repetitive "interlacing" effect produced under both sets of jet operating conditions according to the invention, while the "suction" effect occurs only when the fancy thread is free of braking tension while being subjected to the higher pressure. During this suction effect, the fancy thread accumulates much more rapidly and with a much higher bulking effect along the base thread.

The resulting novelty thread or yarn 20 as it leaves the jet nozzle 15 can be briefly described again in somewhat greater detail in connection with FIGS. 3*a* and 3*b*. First, as seen in FIG. 3*a*, the short yarn segment is that in which the tensioned base thread (heavy lines) is lightly wound or entwined by the likewise tensioned or more weakly braked fancy thread (thin lines) and is entangled or interlaced therewith at the points indicated by the arrows X. Very little bulking or fancy type of composite yarn enlargement occurs over this segment but the two threads, i.e. the base thread identified here as 25 and the fancy thread 26, are still engaged or locked together at the points X of interlacing. In FIG. 3*b*, there is achieved a fancy yarn bulking at the higher pressure where the fancy thread 26 is released from tension. In this case, the still tensioned base thread 25 is sheathed or covered more fully and with much greater voluminosity by loops, coils, curls, etc., of the fancy thread 26 while again being strongly interlaced or almost braided by the entanglement at numerous points X.

The length of the fancy composite yarn segments, i.e. those segments as shown in FIG. 3*b* which are highly looped and coiled, as well as the intervals at which these segments are spaced from each other along the composite yarn, are controlled by the switching back and forth from high to low pressure. This control can take place uniformly or in a random or irregular pattern. It is preferably to provide the fancy or voluminous "effect" lengths of the composite yarn or thread on the order of about 15 to 40 cm. At the same time, it is also preferred to space these fancy or effect portions of the yarn at intervals of between about 1.20 and 12 meters along the treated or entwined and interlaced base thread.

In the jet nozzle 15 shown as a preferred embodiment in FIG. 2, the air feed bore 23 is arranged at a right angle to the yarn entry bore 22. If a stronger suction effect is desired, this air feed bore can be inclined toward the yarn exit direction, i.e. so that the injected air is directed more toward the yarn exit Y*o*. Suitable entangling or interlacing nozzles with the desired suction effect are well known in this art. One may also adapt nozzles such as those disclosed in U.S. Pat. No. 3,460,213 provided that the yarn exit bore is preferably enlarged in comparison to the yarn entry bore, or by simply reversing the direction of the thread or yarn in the nozzles shown in FIGS. 5, 6 and 7 of this patent.

It is even feasible to use so-called Taslan nozzles, as first described for example in U.S. Pat. No. 2,958,112, wherein there are inclined jet and thread conducting channels or bores provided that the feed and draw off speeds are selected to accomodate the relatively higher overfeeds produced with such nozzles.

In general, the exact size and design of the jet nozzle for purpose of the present invention depends upon the yarn size, the kinds of filaments selected and whether or not other kinds of treatments are to be combined with or superimposed upon the essential interlacing and suction effects required herein. The present process is of particular advantage in being very easily applied to the usual synthetic thermoplastic filamentary materials in their common textile yarn sizes. The resulting composite novelty or fancy yarn is therefore widely useful in producing many different fabrics or similar textile products.

The process of the invention is also capable of being used with yarns running at very different velocities, e.g. being just as useful at yarn velocities of only about 80 to 150 m/min as well as much higher velocities of about 600 m/min or more. The upper limit of yarn velocity is dependent only on the rapidity at which the fancy thread braking and the change in air pressures can be effected. The use of nearly inertialess reversible valves makes it possible to carry out the process of the invention on or in conjunction with modern false-twist texturizing machines using a friction-operated false-twist assembly or other false-twisters.

The interlacing within the more voluminous or effect portion of the treated yarn becomes stronger and more coherent or else weaker and less coherent depending upon the height of the upper pressure level and the exact construction of the jet nozzle. In one preferred variation of the process, for example, a weaker interlacing effect is provided in the voluminous or novelty effect portion of the composite yarn so that in subsequent weaving of the yarn into a fabric, the fancy thread in the novelty yarn used as the weft yarn is pushed up along the base thread at the thread brake of the shuttle, thereby forming a somewhat shorter but correspondingly larger nub, nodule, burl, slub or the like. It was surprising that this kind of result could be achieved while also providing a good cohesion over the entire length of the novelty yarn product during normal processing of the yarn up to the point of weaving with the special nub shortening effect.

When using the composite novelty yarn produced according to the invention in the weft of fabrics, one can achieve very interesting and useful cloud effects. The incorporation of this special novelty yarn in both the weft and warp of a fabric leads to linen-type fabrics, especially when there is a stronger interlacing effect of the two thread components within the voluminous or novelty effect portion of the yarn.

Due to the very great number of variations in the length and size as well as the tightness or looseness of a definite interlacing effect, the novelty yarn products of this invention have many useful applications.

EXAMPLE

A bundle of 24 fully drawn dull polyethylene terephthalate filaments (the count of the bundle being dtex 76) coming from the feed spool 4 (as shown in FIG. 1) is conducted by the feed rolls 9 over a deflecting thread guide 10 and over a hot plate 11 which is heated at 225° C. Then it passes the false twist spindle 12 which is rotating at 300,000 turns per minute and is drawn off by the draw rolls 13 at such a speed that the texturized base thread 5' possesses a false twist of 3,400 turns per meter.

A second bundle of 48 fully drawn dull polyethylene terephthalate filaments (the count of this bundle being dtex 150) which has been false-twist texturized at 225° C and possesses a false twist of 2,400 turns per meter, coming from the second feed spool 2 is led to the braking device 16 (as shown in FIG. 1). This bundle is used as the fancy thread 3.

Base thread 5' and fancy thread 3 run together through a jet nozzle 15 of the type shown in FIG. 2. The diameter of the narrower bore 21 is about 2.0 mm., the diameter of the larger bore 22 about 3.0 mm. Opening 23 and resonance chamber 24 have a diameter of 1.4 mm. Compressed air of room temperature is continuously introduced through opening 23, its pressure being varied between a lower value of 1.5 atm. gauge and an upper value of 5.0 atm. gauge.

The resulting novelty yarn 20 is withdrawn from the jet nozzle 15 and wound on the winding device 21 operating at 85 m./min.

What we claim is:

1. A process for the production of a composite novelty yarn which comprises:

conducting a continuous multifilament base thread together with a continuous multifilament fancy thread through a texturizing jet nozzle operating under an adjustable pressure of a fluid medium and being capable of inducing both an interlacing action and a suction action when applied to said threads, at least said base thread consisting essentially of texturized filaments;

varying the pressure of the jet fluid medium applied to said threads between a lower value above atmospheric pressure and a distinctly higher value;

maintaining a relatively high uniform tension on said base thread such that it follows a substantially linear path through the jet nozzle;

maintaining a distinctly lower tension by a light braking on the fancy thread as compared to the tension on the base thread, said light braking taking place during the application of said lower value of the jet pressure; and maintaining the fancy thread practically tension-free and unbraked during the application of said higher value of the jet pressure.

2. A process as claimed in claim 1 wherein the base thread and the fancy thread each consist of a false-twist texturized yarn.

3. A process as claimed in claim 2 wherein the base thread is continuously fed to the jet nozzle directly from a false-twist texturizing zone while the fancy thread is drawn off from a feed spool.

4. A process as claimed in claim 3 wherein the base thread is stretched directly before the false-twist texturizing zone.

5. A process as claimed in claim 3 wherein the base thread is stretched in the false-twist texturizing zone.

6. A process as claimed in claim 1 wherein the fluid medium of the jet nozzle is air, and the jet pressure is varied between a lower value of about 0.5 to 2.0 atm. gauge and an upper value of about 4.0 to 5.0 atm. gauge.

7. A process as claimed in claim 6 wherein the texturized base thread is conducted to the jet nozzle with an overfeed of about 2.5 to 3.5%.

8. A process as claimed in claim 6 wherein the absolute winding tension amounts to about 6 to 10 grams.

9. A process as claimed in claim 8 wherein the winding tension lies between about 0.025 and 0.04 grams/dtex.

10. A process as claimed in claim 1 wherein the jet pressure is varied by switching back and forth between said lower and said higher pressure values according to a predetermined program, and the light braking of the fancy thread is applied simultaneously with a switching to the lower pressure value and is then released simultaneously with a switching to the higher pressure value.

* * * * *